United States Patent [19]

Louët Feisser

[11] Patent Number: 4,582,096

[45] Date of Patent: Apr. 15, 1986

[54] HANDLOOM PROVIDED WITH A MECHANISM FOR VARIATION OF THE DISTANCE BETWEEN BREASTBEAM AND BACK BEAM

[75] Inventor: Jan J. J. Louët Feisser, Laren, Netherlands

[73] Assignee: Louet Beeher B.V., Lochem, Netherlands

[21] Appl. No.: 690,518

[22] Filed: Jan. 11, 1985

[30] Foreign Application Priority Data

Jan. 17, 1984 [NL] Netherlands ..... 8400142

[51] Int. Cl.[4] ..... D03D 29/00

[52] U.S. Cl. ..... 139/29

[58] Field of Search ..... 139/29, 30, 31, 32, 139/33, 25, 291 R, 292, 304

[56] References Cited

U.S. PATENT DOCUMENTS 4,489,761 12/1984 Van Gulik ..... 139/29

FOREIGN PATENT DOCUMENTS 728492 4/1932 France ..... 139/33

*Primary Examiner*—Henry S. Jaudon
*Assistant Examiner*—Joseph S. Machuga
*Attorney, Agent, or Firm*—Leonard Bloom

[57] ABSTRACT

A handloom provided with a warp beam for the supply of warp threads, a back beam for guiding the wrap to the weaving plane and a cloth beam for advancing the fabric. There are means provided for variation of the distance between the back beam and the breastbeam. The breastbeam is moveable substantially in the direction of the back beam and parallel to its starting position. Resilient members are present which exert a force away from the back beam on the breastbeam.

14 Claims, 1 Drawing Figure

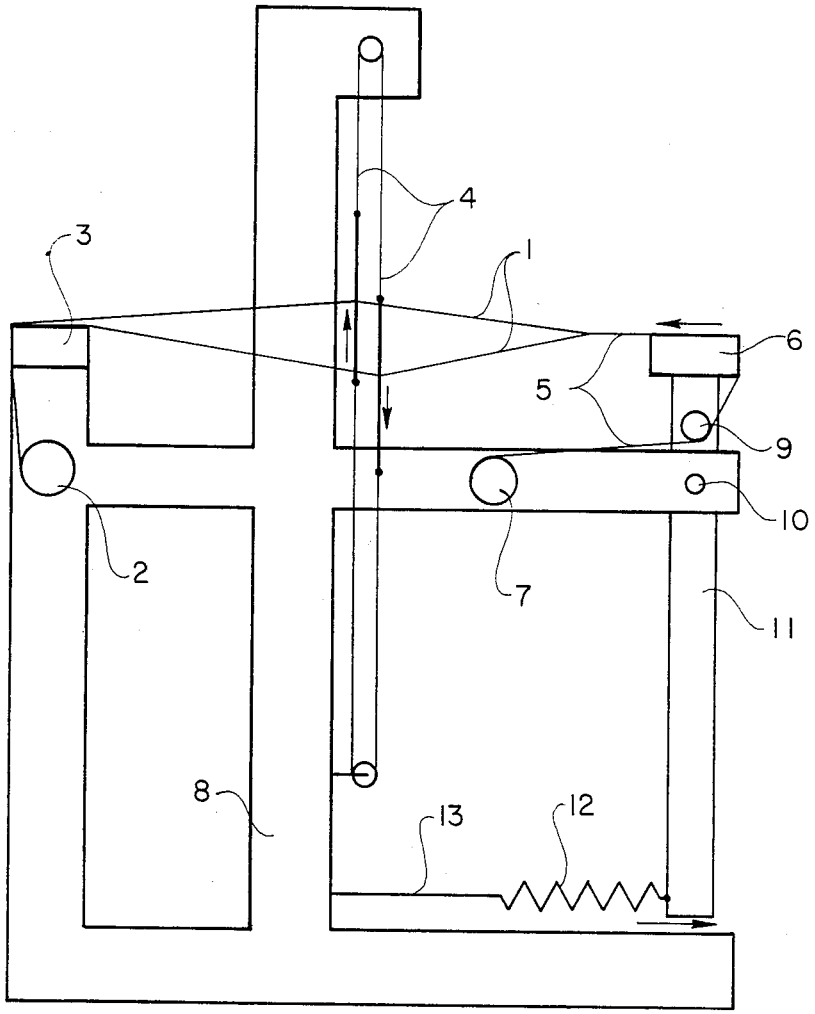
4
3
1
6
5
9
10
2
7
11
8
13
12

HANDLOOM PROVIDED WITH A MECHANISM FOR VARIATION OF THE DISTANCE BETWEEN BREASTBEAM AND BACK BEAM

The invention relates to a handloom, provided with a warp beam for the storage and supply of warp threads, a back beam for guiding the warp threads to the weaving plane, a breastbeam for guiding the fabric from the weaving plane and a cloth beam for advancing the fabric, in which means are provided for variation of the distance between the back beam and the breastbeam.

In weaving, every warp thread which has been tensioned in the loom is led through a heddle. These heddles are fastened group by group in harnesses. The harnesses can be moved substantially crosswise to the direction of the weaving plane. This arrangement results in the formation of a clearance between the warp threads, called shed, through which the weft thread is caused to impinge on the already formed fabric by means of an impact member, called reed. The harnesses are worked with the aid of handles or treadles. To enable a large amount of weft thread to be passed through, it is important that the movements of the harnesses create a wide clearance between the warp threads without any undue increase in the warp tension and/or adverse effects on operation.

In virtually all types of handloom the back beam and the breastbeam are fixed, in consequence whereof the warp tension increases considerably during the formation of the shed. The use of an inelastic warp material in particular severely limits the height of the shed and involves the danger of the warp threads being ruptured or damaged. The force required to operate the harnesses increases according as the warp tension is higher and rises during the formation of the shed. In addition, the requisite operation force is increased during the shed formation by the angle at which the harness is exposed to the warp tension. Systems designed to solve this problem by regulation of the tension during shed formation are called compensation devices.

In the present state of the art there are compensation devices of a mechanical and a hydropneumatic nature. The desired effect is attained by moving the breastbeam and the back beam towards each other during shed formation, so that the length of the warp stretched in between need not, or hardly, change. Only mechanical compensation devices can be adapted for use in a handloom. A known mechanical compensation device has a back beam moving towards the breastbeam during shed formation. The movement of the back beam is induced by a mechanism that is linked to the drive of the harnesses. This mechanism can be designed such that the length of the warp between breastbeam and back beam, and hence the warp tension, remains virtually constant during shed formation. It has been developed specifically for industrial looms, but when applied to a handloom it has the following disadvantage, among other things. The harnesses of a handloom are driven by a number of treadles or handles, generally four, six, eight or ten, but sometimes even more. As every handle or treadle has to move not only the harnesses but also the back beam, every handle or treadle requires a mechanism which actuates the back beam. When used for a handloom, the existing system will thereby become complex and expensive. This disadvantage will worsen when the handloom is to be extended so as to include more treadles or handles than the number provided in its simplest design.

During shed formation in a handloom, it is desirable for the warp tension to increase somewhat, since this will facilitate the return of the warp threads in the weaving plane when the harnesses are no longer operated.

It is an object of the present invention to provide a handloom having a simple mechanism for regulating the distance between back beam and breastbeam in such a fashion that the warp tension increases only slightly during the formation of the shed. To this end, the breastbeam is disposed in the loom according to the invention so as to be movable substantially in the direction of the back beam and parallel to its starting position, while resilient members are present which exert a force away from the back beam on the breastbeam. In order to guide the movement of the breastbeam, the latter may, according to a feature of the invention, form part of a pivoting frame whose axis of swivel runs parallel to and below the breastbeam.

During the movement of the breastbeam, the tension in the fabric located between breastbeam and cloth beam is subject to changes. Any great change in this tension is undesirable, however. This problem can be solved according to a further feature of the invention by the provision of a guide for the fabric near the axis of swivel of the pivoting frame, so that the movement of the pivoting frame with the associated breastbeam causes very little change to the length, and hence to the tension, of the fabric between breastbeam and cloth beam.

The resilient members can exert their force on the breastbeam through the pivoting frame. To achieve this, they have been disposed between the pivoting frame and the fixed part of the loom. At a certain desired warp tension, the requisite force of the resilient members depends upon the length of the actuating arm of the said members relative to the axis of swivel and on the distance between the axis of swivel and the breastbeam. The resilient members are preferably of a light construction as commonly known in domestic use. According to a feature of the invention, the actuating arm of the resilient members relative to the axis of swivel may therefore be considerably longer than the distance between the axis of swivel and the breastbeam.

As a handloom must be capable of weaving different types of fabric in different widths and from different materials, it is desirable that the force of the resilient members admits of variation. Accordingly, it is a feature of the invention that the resilient members may be given a desirable initial tension. In order to render the tension even more variable, according to a further feature of the invention the resilient members may consist of a variable number of springs. This arrangement also has the advantage that a relatively small resilience per spring will suffice, so that the springs can be readily mounted and/or subjected to the desired tension.

To elucidate the invention, an embodiment will now be described by way of example with reference to the accompanying drawing.

The FIGURE is a simplified diagram of an embodiment in which the warp (1) is held in stock on the warp beam (2), guided through the back beam (3) and then passed through the heddles which have been grouped in harnesses (4). Between the harnesses (4) and the breastbeam (6) the warp (1) is turned into fabric (5) during the weaving process. The resultant fabric (5) is passed via the breastbeam (6) to the cloth beam (7). Breastbeam (6) forms part of a pivoting frame (11) whose axis of swivel (10) is located parallel to and underneath the breastbeam (6). Fabric (5) is passed between breastbeam (6) and cloth beam (7) through a guide (9) disposed near the axis of swivel (10). Resilient members (12) are attached between the pivoting frame (11) and a longitudinally adjustable link (13) which is in its turn attached to the frame of the loom (8). When the harnesses (4) are worked in the direction indicated by the arrows, the increasing tension on the warp (1) will be compensated by the displacement of the breastbeam (6) in the direction of the arrow. At the same time the bottommost part of the pivoting frame (11) will move in the direction of the appropriate arrow. The resilient members (12) will be stretched such that their elongation is substantially equal to the displacement of the bottommost part of the pivoting frame (11). The degree to which the tension of the warp (1) changes during the movement of the harnesses (4) bears a certain ratio to the degree to which the tension of the resilient members (12) changes during their elongation. This ratio is governed by the length of the actuating arm of the resilient members (12) relative to the axis of swivel (10) and the distance between breastbeam (6) and axis of swivel (10). Changes in tension on the warp (1) will be relatively slight when the resilient members (12) are chosen such that they undergo relatively little change in tension upon a variation of their length. The provision of a longitudinally adjustable link (13) makes it possible to impart a desirable initial tension to the resilient members (12).

I claim:

1. A handloom provided with a warp beam for the supply of warp threads, a back beam for guiding the warp of the weaving plane, a breastbeam for guiding the fabric from the weaving plane and a cloth beam for advancing the fabric, in which means are provided for variation of the distance between the back beam and the breastbeam, characterized in that the breastbeam is movable substantially in the direction of the back beam and parallel to its starting position and that resilient members are present which exert a force away from the back beam on the breastbeam.

2. A handloom according to claim 1, characterized in that the breastbeam forms part of a pivoting frame whose axis of swivel runs parallel to and below the breastbeam.

3. A handloom according to claim 2, characterized in that a guide for the fabric is provided near the axis of swivel of the pivoting frame.

4. A handloom according to claim 2 or 3, characterized in that the resilient members are disposed between the pivoting frame and the fixed part of the loom in such a fashion that their actuating arm relative to the axis of swivel is considerably longer than the distance between the axis of swivel and the breastbeam.

5. A handloom according to claim 4, wherein the tension of the resilient members is adjustable.

6. A handloom according to claim 5, wherein the resilient members consist of a variable number of springs.

7. A handloom according to claim 1, wherein the tension of the resilient members is adjustable.

8. A handloom according to claim 7, wherein the resilient members consist of a variable number of springs.

9. A handloom according to claim 1, wherein the resilient members consist of a variable number of springs.

10. A handloom according to claim 2, wherein the tension of the resilient members is adjustable.

11. A handloom according to claim 2, wherein the resilient members consist of a variable number of springs.

12. A handloom according to claim 3, wherein the tension of the resilient members is adjustable.

13. A handloom according to claim 3, wherein the resilient members consist of a variable number of springs.

14. A handloom according to claim 4, wherein the resilient members consist of a variable number of springs.

* * * * *